United States Patent [19]

Andreasson

[11] Patent Number: 4,495,911

[45] Date of Patent: Jan. 29, 1985

[54] CHOKE DEVICE

[75] Inventor: Jan Y. N. Andreasson, Huskvarna, Sweden

[73] Assignee: EMAB Electrolux Motor Aktiebolag, Sweden

[21] Appl. No.: 403,646

[22] PCT Filed: Dec. 1, 1981

[86] PCT No.: PCT/SE81/00350

§ 371 Date: Jul. 16, 1982

§ 102(e) Date: Jul. 16, 1982

[87] PCT Pub. No.: WO82/01917

PCT Pub. Date: Jun. 10, 1982

[30] Foreign Application Priority Data

Dec. 2, 1980 [SE] Sweden ..... 8008463

[51] Int. Cl.[3] ..... F02B 77/00; F02M 1/02

[52] U.S. Cl. ..... 123/198 R; 123/198 D; 123/198 E; 261/64 E

[58] Field of Search ..... 123/198 D, 527, 198 E, 123/198 R; 261/64 E

[56] References Cited

U.S. PATENT DOCUMENTS 3,081,160 3/1963 Ensign ..... 123/527

4,308,843 1/1982 Garretson ..... 123/527

*Primary Examiner*—Ira S. Lazarus

*Attorney, Agent, or Firm*—Alfred E. Miller

[57] ABSTRACT

An air filter in front of the intake opening of the carburetor has an elastic lower surface (20) with a bead (19) which is movable in the intake opening. The displacement is adjusted by means of a choke control (22) which at maximum deflection presses the whole bead into the intake opening.

7 Claims, 1 Drawing Figure

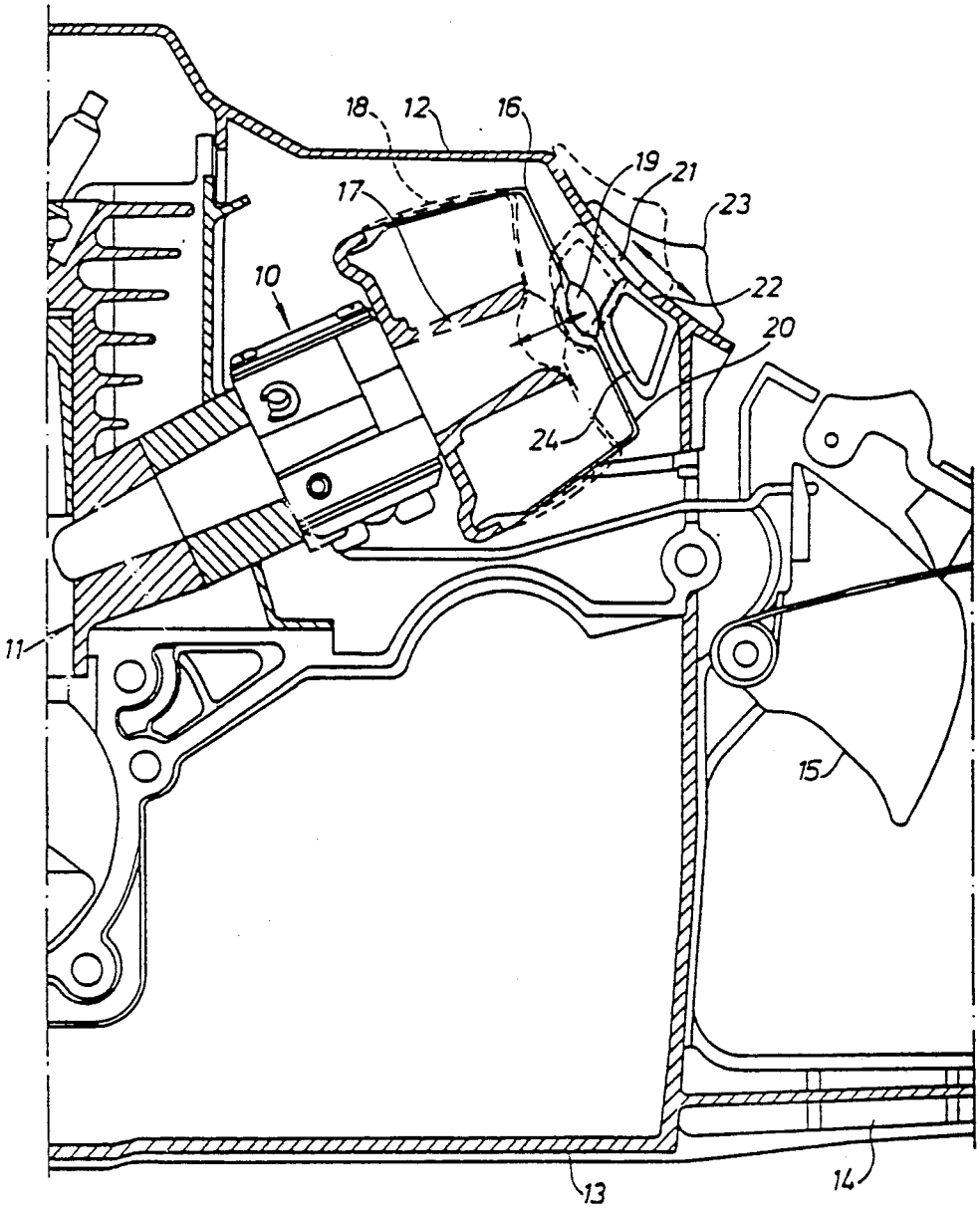
18
12
16
19
21
23
17
10
22
20
24
11
15
13
14

CHOKE DEVICE

This invention relates to a choke device for an internal combustion engine mounted on a bracket around the intake pipe of the carburetor.

Conventional choke throttles cause power dissipation, they are composed of a great number of parts and are not always reliable in operation. It is desirable, especially in small engines, to simplify the choke function and render it more effective. This is difficult to achieve on conventional throttles which do not choke the intake air sufficiently. Since such throttles are not considered improvable this invention deals with another type of choking which simplifies the function and makes it more effective.

In accordance with the invention an air filter is provided which has its choke function built in at the end of the intake pipe of the carburetor where a central part of the framework of the air filter forms a so-called distribution cone in the intake opening. Since the framework is of an elastic material the cone can be moved in the opening and even be pressed against it so that the intake is plugged up. In the normal position the cone is outside the intake opening and lets the combustion air easily pass by. The choke control is preferably arranged as a valve in a recess in an engine hood or the like which surrounds the carburetor. The part of the valve which is turned against the air filter has a curvature which presses against the central part of the framework of the air filter which thereby is allotted different throttling positions depending on the position of the valve in the recess. The valve can easily be moved therein by means of a button disposed on the outside of the hood.

An embodiment of air filter and choke device according to the invention is described below with reference to the accompanying drawing which shows a carburetor with air filter and choke device according to the invention in a vertical cross-section view.

The carburetor 10 is included in an internal combustion engine 11 which is partly shown in the FIGURE and used in a hand-held device, for example a motor saw with hoods 12,13 around the engine and a handle 14 equipped with a gas control 15. The upper hood 12 contains a carburetor body within which an air filter 16 is mounted at the end of the intake pipe 17. The framework 18 of the filter is of elastic, perforated material which is easily bent and resilient. The filter has a so-called distribution cone 19 in the form of a bead in the centre of the lower part 20 of the framework of the filter.

In the upper hood 12 a recess 21 is made opposite to the cone 19 in which a valve 22 is placed. The valve is movable in the recess between the positions shown by a continuous line and a broken line, respectively. On the outside of the hood the valve has a button 23 whereby it can easily be moved from one position to the other. The part of the valve which is turned inwards has a curved section 24 which strikes the outside of the bead of cone 19 when the valve is moved from the continuous position to the broken one. The pressure from the curved section against the bead moves the latter towards the intake opening whereby the intake is choked to an extent determined by the displacement of the valve in the recess. When the valve is moved to the broken position the cone is totally inserted in the intake opening which is thus covered entirely, as shown by the broken outline of the framework 18. When the valve is moved back to the continuous position shown in the FIGURE the lower part of the framework springs back and causes the inake pipe to open again.

The device described above has only two movable parts, which is advantageous and gives reliability of operation and a low manufacturing cost. The parts can, however, be varied as to performance, the valve can for example be replaced by a lever lodged in a through hole in the hood 12. Further, the bead on the surface of the lower part 20 can be excluded.

I claim:

1. In an internal combustion engine system having an air filter mounted on the intake opening of a carburetor; the improvement wherein the air filter comprises elastic frame means resiliently supporting a limiting wall means at a position spaced from said intake opening, and further comprising manually operable means mounted to selectively engage said limiting wall means to enable the blocking of said intake opening with said limiting wall means.

2. The engine system of claim 1 wherein said limiting wall is parallel to said intake opening.

3. The engine system of claim 1 wherein said limiting wall means has a bead facing said intake opening and adapted to block said opening when urged toward said opening.

4. The engine system of claim 1 wherein said elastic frame means is of a porous material.

5. The engine system of claim 1 wherein said limiting wall means comprises a bead adapted to be moved into said intake opening by said manually operable means, for closing said intake opening.

6. The engine system of claim 1 wherein said limiting wall is biased by the resilience of said elastic frame means to a position displaced from said opening, and said manually operable means comprises means for moving said wall means toward the intake opening.

7. The engine system of claim 6 further comprising a hood surrounding said engine and having a recess aligned with said air filter, said manually operable means comprising a valve member movable in said recess for pressing against said limiting wall means.

* * * * *